United States Patent [19]

Nerlich

[11] 4,220,424

[45] Sep. 2, 1980

[54] VALVE ARRANGEMENT FOR A WALKING MINE ROOF SUPPORT

[75] Inventor: Ernst-Günter Nerlich, Essen, Fed. Rep. of Germany

[73] Assignee: Bochumer Eisenhütte Heintzmann GmbH & Co., Bochum, Fed. Rep. of Germany

[21] Appl. No.: 963,959

[22] Filed: Nov. 27, 1978

[30] Foreign Application Priority Data

Dec. 13, 1977 [DE] Fed. Rep. of Germany ..... 2755392

[51] Int. Cl.[3] ..... E21D 15/44

[52] U.S. Cl. ..... 405/302

[58] Field of Search ..... 405/291-302; 299/33; 91/511, 533, 536, 170 MP-189

[56] References Cited

U.S. PATENT DOCUMENTS

| | | | |
|---|---|---|---|
| 3,309,880 | 3/1967 | Potts et al. | 405/302 |
| 3,631,681 | 1/1972 | Taylor | 405/302 |

FOREIGN PATENT DOCUMENTS

| | | | |
|---|---|---|---|
| 982978 | 2/1965 | United Kingdom | 405/302 |
| 1202358 | 8/1970 | United Kingdom | 405/302 |

*Primary Examiner*—Dennis L. Taylor

*Attorney, Agent, or Firm*—Michael J. Striker

[57] ABSTRACT

A valve arrangement for operating a walking mine roof support so as to automatically move the props of the mine roof support first to a collapsed position and advancing the mine roof support and only thereafter moving the props to their extended position and in which control of the valve arrangement is carried out with the pressure fluid which acts on the members of the walking mine roof support.

8 Claims, 2 Drawing Figures

VALVE ARRANGEMENT FOR A WALKING MINE ROOF SUPPORT

BACKGROUND OF THE INVENTION

The present invention relates to a valve arrangement for a walking mine roof support with a plurality of props for pressing a roof shield against the roof of the mine gallery and in which the lower ends of the props are mounted on a sole plate, constructed as a hydraulically operated clyinder-and-piston unit forming an advancing unit of the mine roof support and in which, after applying an impulse, the props are automatically moved to a collapsed position while the mine roof support is advanced by the advancing unit and subsequently thereto the props are again automatically moved to an extended position pressing the roof shield against the roof of the mine gallery.

In valve arrangements of the aforementioned kind so far known in the art which provide an automatic sequence of the above-mentioned operating steps, that is moving the props to the collapsed position, advancing the mine roof support and subsequently moving the props again to the extended position, these subsequent steps have been carried out by using a separate control medium. Usually compressed air or hydraulic media at low pressure were used for this purpose. The disadvantage of this known arrangement is, therefore, that in addition to the conduits and aggregates for the working medium under high pressure, additional conduits and aggregates for a control medium must be provided. This makes these known arrangements rather expensive. In addition these known arrangements with the additional conduits and aggregates for the control will necessarily create trouble spots and increased maintenance cost.

A further problem of the known valve arrangements will result from the fact that moving the props back to the extended position after advancing of the mine roof support is carried out in a time-, distance- or pressure-depending manner. If, for instance, the moving of the props back to the extended position is carried out in time dependence, then it is possible that, due to a clogged filter or by simultaneously actuating a plurality of mine roof supports, not enough working medium is available in order to advance the advancing means through the desired distance. In this case the movement of the props to the extended position will be carried out at a moment at which the advancing unit has not finished its function. On the other hand, it is of disadvantage that, by control strictly depending on the distance, the movement of the props to the extended position can be started only after the advancing means has moved the mine roof support through the predetermined distance. Due to the rough operating conditions in underground mine galleries it is, however, possible that the predetermined distance will not be reached. In this case the props will remain in the collapsed position and not press the roof shield against the mine roof. On the other hand, if the movement of the props back to the extended position is carried out strictly pressure-dependent, then it is possible that the props start moving to the extended position before the advance of the mine roof support has been finished. This is, for instance, the case if the advancing mine roof support hits an obstacle causing thereby a momentary pressure peak in the advancing unit, which initiates start of movement of the props to the extended position.

SUMMARY OF THE INVENTION

It is an object of the present invention to provide a valve arrangement for a walking mine roof support which avoids the disadvantages of such valve arrangements known in the art.

More specifically, it is an object of the present invention to provide a valve arrangement for a walking mine roof support which does not require an additional control medium and which uses only the high pressure control medium as a means for carrying out the working steps of moving the propos to the collapsed position, advancing the mine roof support and thereafter moving the props again to the extended position, while avoiding a strictly time-, distance- or pressure-dependent regulation of the steps.

With these and other objects in view, which will become apparent as the description proceeds, the present invention relates, in combination with a walking mine roof support having a plurality of hydraulically operated props, each movable between an extended position by feeding pressure fluid into a cylinder space below a piston thereof and a collapsed position by discharging pressure fluid from the cylinder space and advancing means comprising a hydraulically operable cylinder-and-piston unit for advancing the mine roof support upon feeding of pressure fluid into the cylinder of the unit, to a valve arrangement for automatically moving the props to the collapsed position and advancing the mine roof support by the advancing means and thereafter moving the props back to the extended position, in which the aforementioned elements are moved in proper sequence only by a high pressure working medium and in which the valve arrangement mainly comprises a stepped piston arranged in a correspondingly stepped bore of a housing, in which the piston after an impulse for starting the aforementioned sequence of movements of the elements of the walking mine roof support is impinged on opposite sides by two fluid pressures which determine its axial movement. One of the fluid pressures is the pump pressure of the arrangement which, over a one-way valve, acts on an annular surface of the stepped piston. This annular surface faces an annular pressure space which, through an adjustable overpressure valve, is connected with a return conduit for the working medium. The other face of the stepped piston is impinged by the pressure of the fluid in the cylinder of the advancing unit, which carries out the movement of the walking mine roof support. When now the advancing unit has finished its predetermined stroke then the available pressure surpasses a predetermined magnitude so that due to the different size of the two pressure faces of the stepped piston a higher pressure will result in the aforementioned annular space. If the increasing pressure reaches then the pressure to which the overpressure valve has been adjusted, the latter will open and the pressure medium in the aforementioned annular space will be discharged into the return conduit. Simultaneously, the stepped piston will move axially, whereby the speed of this axial movement is preferably determined by a throttle arranged upstream of the end face of the stepped piston. The one-way valve, over which the working medium is directed onto the annular face of the stepped piston, remains thereby closed since now the pressure in the annular space is greater than the pump pressure. Due to the time delayed movement of the stepped piston, which regulates flow of the working medium to the cylinder spaces below the pistons of the props, the discharge of the pump pressure over the stepped piston will occur only after a certain time which is determined by the flow cross-section of the throttle. Instantaneous pressure peaks during movement of the walking mine roof support against obstructions have therefore no influence on the continuous operating sequence of the elements of the walking mine roof support.

After the stepped piston has reached its position in which pressure fluid is fed to the cylinder spaces of the props it will establish at the same time flow of pressure fluid over an adjustable throttle onto one side of a return piston, the other side of which is continuously impinged by the pump pressure. Due to the pump pressure acting over the stepped piston and the throttle on the return piston, the latter will move, time delayed in dependence on the flow cross-section of the throttle, whereby the advancing unit and the stepped piston are connected with the return conduit for the working medium. The time delayed movement of the return piston and therewith the time up to the interruption of the connection between the advancing unit and the stepped piston is regulated in such a manner that a perfect movement of the props back to the extended position with the necessary operating pressure is assured.

The construction according to the present invention provides, therefore, a mutual relationship between two, over throttles at least indirectly connected, hydraulic piston systems which, under use of the pump pressure will assure a proper sequence of movement of the elements of the walking mine roof support, while preventing a time-, distance- or pressure-dependency of these movements.

According to the present invention a spring loaded closer body with two axially displaced closer members is coordinated with the stepped piston. The closer body can thereby be guided axially movable in a hollow extension of the stepped piston, whereby the outer surface of the hollow cylinder is sealed with respect to the housing. The closer member at the front end of the closer body cooperates with a sealing face provided in the housing at a passage which leads to the return conduit. The other of the closer members is pressed by a spring against a sealing face in the interior of the hollow cylinder. When the stepped piston is axially moved by the working fluid, then the closer member at the end of the closer body engages the sealing face in the passage leading to the return conduit and closes this passage. During further axial movement of the stepped piston the other sealing member becomes disengaged from the sealing face in the hollow cylinder, so that the working medium may now flow past this sealing face to the cylinder spaces of the props.

In order to assure that the sealing member cooperating with the sealing face in the hollow cylinder will be properly opened, the closer body is provided with a longitudinal bore therethrough. The closer body is thereby relieved of pressure, because this longitudinal bore is connected with the return conduit. In addition the end face of the stepped piston which is connected with the advancing unit has a larger area than the opposite annular face of the stepped piston so that the resulting force in opening direction is always greater.

According to a further advantageous feature of the present invention, the return piston is provided with a push rod which cooperates with a one-way valve forming part of a two-part closer arrangement or first valve means located upstream of the stepped piston and which, on the one hand is impinged by the pump pressure and on the other hand by a return spring.

This two-part closer arrangement or first valve means establishes at a starting position of the valve arrangement a connection between the return conduit of the working fluid and the opening piston of a releasable non-return valve cooperating with the cylinder spaces of the props and the cylinder of the advancing unit. In addition, a connection over the throttle is provided to the end face of the stepped piston. The closer arrangement loaded at one side by a spring closes thereby the conduit feeding the working medium to the valve arrangement. If, however, the other side of the two-part closer arrangement is by an impulse loaded with the pump pressure, then the return conduit is first closed and subsequently thereto the conduit for the working fluid is connected with the stepped piston and with the conduit which leads to the cylinder space of the advancing unit, as well as to the opening piston of the releasable one-way valves for the cylinder spaces of the props. if now the one-way valve in the closer arrangement is opened by the push rod of the return piston, then the pressure in the closer arrangement is released towards the return conduit. The closer arrangement or first valve means is thereby axially moved and closes the feed conduit of the working fluid while simultaneously providing a connection to the return conduit.

In this connection it is advantageous that the first valve means comprise a spring pressed closer piston and an impulse piston provided with transmitting channels and which may be fluid-tightly connected with the closer piston. The closer piston is formed with a longitudinal bore therethrough which guides the push rod of the return piston. The one-way valve is mounted in the impulse piston and movable together with the same. The closer piston and the impulse piston engage each other to be then in the coupling region fluid-tightly and pressure-tightly connected to each other. According to a further feature of the present invention, the coupling region of the closer piston and the impulse piston is connected with the opening pistons of hydraulically releasable non-return valves arranged in the conduits leading to the cylinder spaces of the props and the cylinder of the advancing unit. The coupling region is reduced in diameter so that even when the impulse piston and the closer piston are pressed against each other, a connection between the advancing unit and the stepped piston is assured.

In order to be able to manually interrupt the automatic sequence of the movement of the elements of the walking mine roof support, the invention provides also for an interrupter member in form of an impulse valve which on the one hand is arranged between the pressure conduit, respectively the return conduit and on the other hand the impulse piston.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
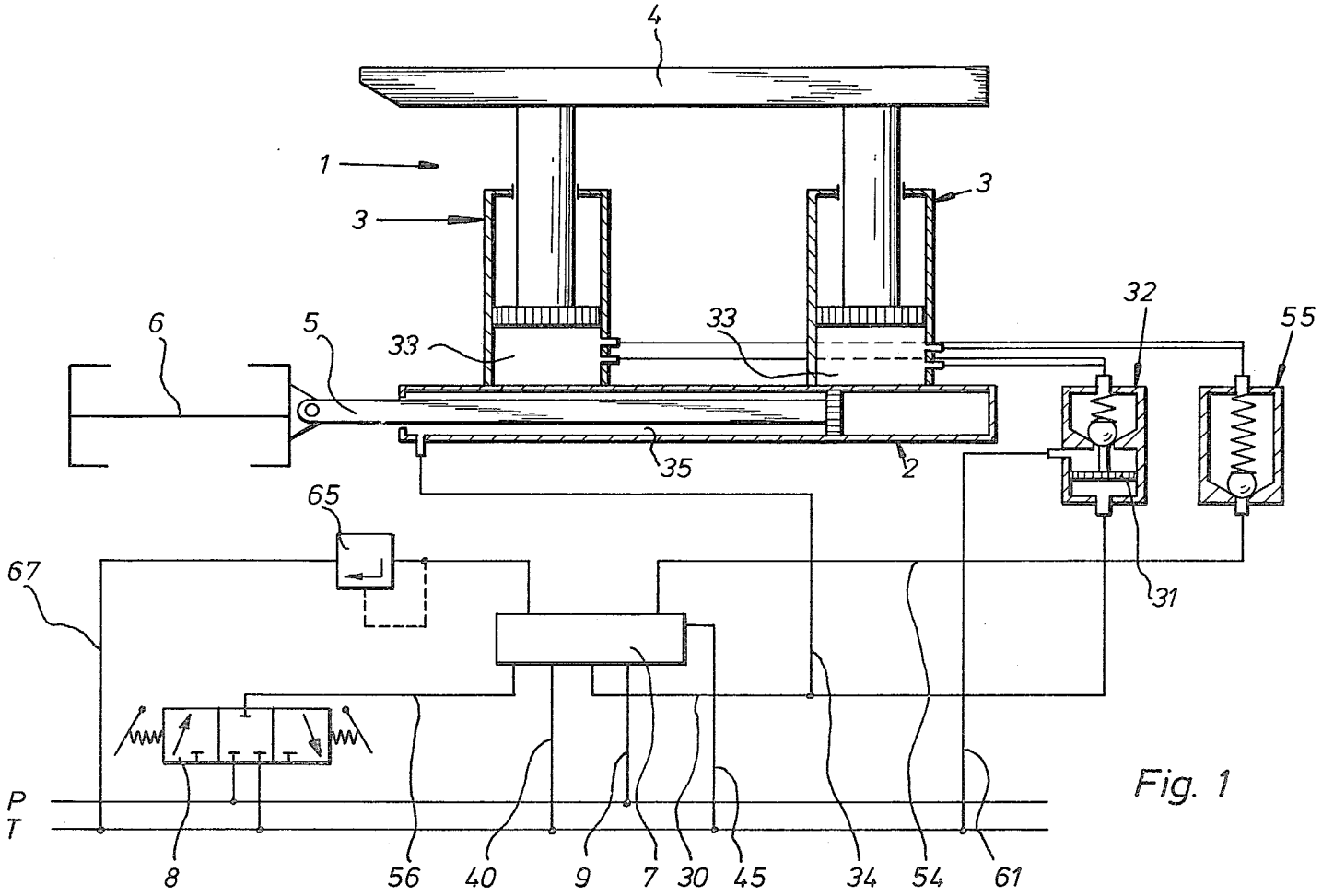
FIG. 1 is a schematic longitudinal cross-section of the walking mine roof support and the valve arrangement coordinated therewith.

FIG. 1 schematically illustrates a walking mine roof support 1, which comprises a sole plate 2, two hydraulically operated props 3 and a roof shield 4 connected to the upper ends of the props. The schematically illustrated sole plate 2 is constructed as an advancing unit including an elongated cylinder and a piston slidably guided therein having a piston rod 5 projecting through the front end of the cylinder and being connected to a conveyor 6 extending traverse to the mine gallery in which the walking mine roof support is to be arranged. Depending on the mining progress, the walking mine roof support is advanced, while being braced by the conveyor 6. A valve arrangement 7 is provided for this purpose which is actuated by a three-port, three-position valve constructed as an impulse valve 8. FIG. 1 shows also a pressure conduit P connected to a non-illustrated source of fluid pressure, for instance a pump, and a return conduit T connected to a non-illustrated tank. These conduits are arranged in the mine gallery in which the walking mine roof support 1 is provided.

Figure 2:
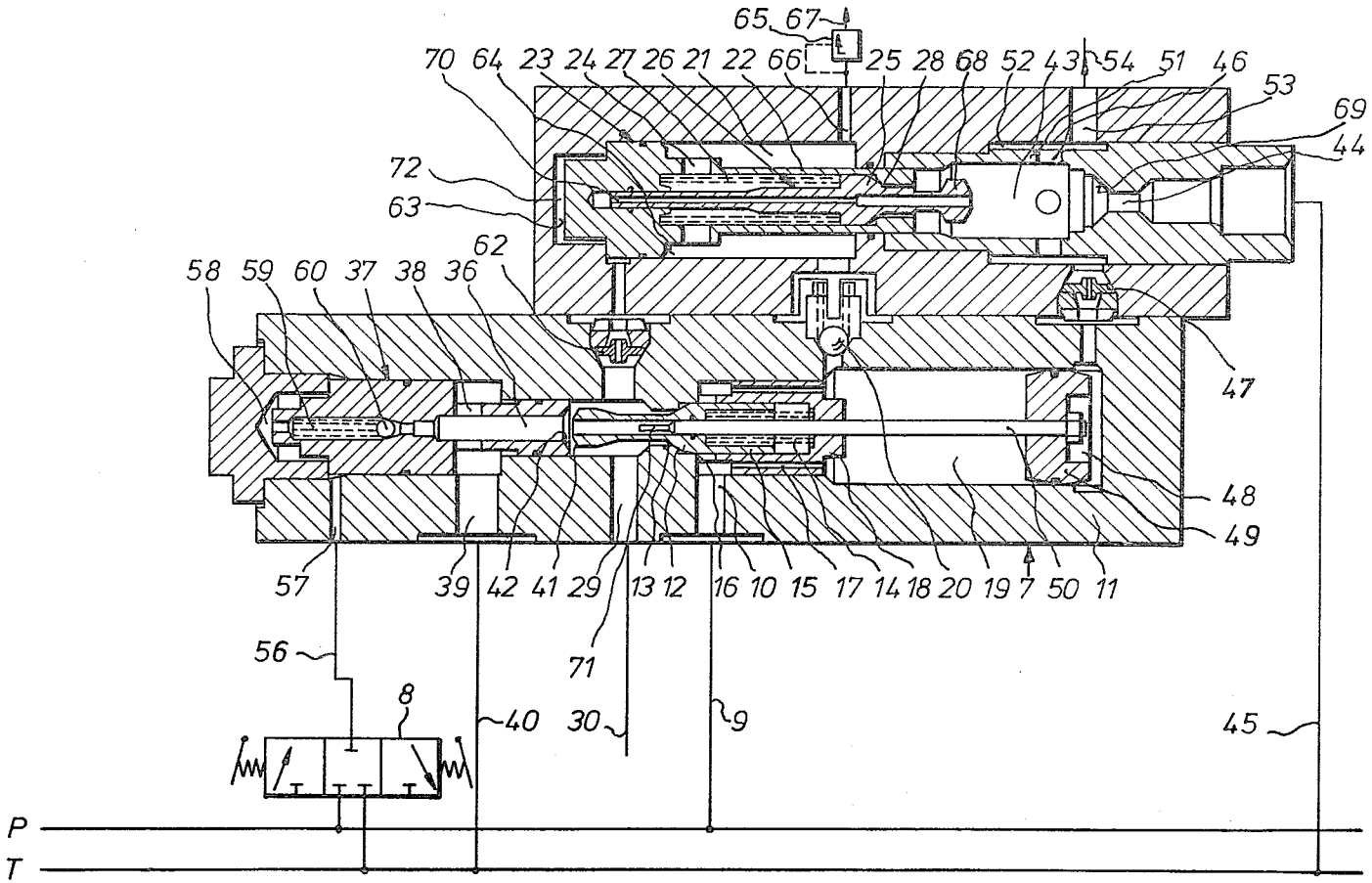
FIG. 2 is a longitudinal cross-section through the valve arrangement shown in FIG. 1.

As can be seen from FIGS. 1 and 2, the pump pressure from the pressure conduit P is transmitted over a conduit 9 and a channel 10 in the housing 11 of the valve arrangement 7 to a valve seat 12 formed by an annular face 16 in the housing of the valve arrangement and engageable by the cone 13 of a closer piston 15 loaded by a spring 14. The pump pressure in the channel 10 is further transmitted over longitudinal bores 17, provided in a plug 18 guiding the closer piston 15, to a cylinder space 19. The cylinder space 19 is connected through a passage in which a oneway valve 20 is arranged with another annular cylinder space 21 through which a hollow cylindrical extension 22 of a stepped piston 23 extends. The hollow cylindrical extension 22 is provided with a transverse bore 24 so that the pump pressure will also act in the hollow cylinder and therewith onto a conical closer member 25, which forms part of a closer body 26 mounted axially movable in the hollow cylinder. The conical closer member 25 is pressed by a spring 27 against a sealing face 28 formed in the hollow cylinder.

A further channel 29 is provided in the housing 11 extending parallel to the channel 10 and the further channel 29 is connected by a conduit 30 with the opening piston 31 (FIG. 1) of a hydraulically openable one-way valve 32, coordinated with the cylinder spaces 33 below the pistons of the props 3. For simplification reason only a single one-way valve 32 is shown in FIG. 1. The channel 29 is further connected over a conduit 34, branching off from the conduit 30, with the cylinder space of the advancing unit 2 through which the piston rod 5 extends. In the position shown in FIG. 2, the channel 29 is connected over a longitudinal bore 36 in an impulse piston 37, as well as through a transverse bore 38, to a channel 39, which in turn is connected by a conduit 40 with the return conduit T. The impulse piston 37 and the closer piston 15 form together a closer arrangement or first valve means which will be explained later on in further detail. The impulse piston 37 and the closer piston 15 are fluid-tightly and pressure-tightly engageable with each other for which purpose the closer piston is provided with a conical sealing head 41 and the impulse piston 37 with the corresponding sealing face 42.

The space 43 receiving the hollow cylinder 22 of the stepped piston 23 is likewise connected through a stepped connecting channel 44 and a conduit 45 with the return conduit T. The space 43 is further connected over cross channels 46 and a throttle 47 with a space 48 arranged to one side of a return piston 49. The return piston 49 is provided with a push rod 50 projecting therefrom opposite to the space 48 and passing through an axial bore in the plug 18 and the closer piston 15 and being guided movable in longitudinal direction in the latter. The above-mentioned space 43 is formed in the interior of a sleeve 51 which is arranged in a bore 52 of the housing 11 with a central portion of the sleeve 51 radially spaced from the bore surface. The bore 52 is connected through a channel 53 in the housing 11 and a conduit 54 with one-way or check valves 55, which in turn are connected to the cylinder spaces 33 of the props 3. For simplification reason again only one check valve 55 is shown in FIG. 1.

If now the impulse valve 8 is manually momentarily moved from the neutral position, shown in FIG. 1, towards the right, then the pump pressure from the pressure conduit P is transmitted over a conduit 56 and a channel 57 in the housing 11 into the space 58 at the left end, as viewed in FIG. 2, of the impulse piston 37. This pressure will act also over a longitudinal bore 59 in the impulse piston 37 onto the one-way valve 60 in the impulse piston and hold the latter closed. The impulse piston will now be axially moved towards the right by the pump pressure, whereby the sealing face 42 of the impulse piston 37 will fluid-tightly and pressure-tightly engage the sealing head 41 of the closer piston 15. Thereby the connection between the channel 29 and the return channel 39 is interrupted. During further movement of the impulse piston 37 towards the right, as viewed in FIG. 2, the impulse piston will also move the closer piston 15 towards the right and the sealing come 13 of the closer piston 15 will be disengaged from the sealing face 16 so that the pump pressure prevailing in the channel 10 will act past the sealing face 12 through the channel 29 and the conduit 30 onto the opening piston 31 of the corresponding one-way valve 32, to open the latter. Pressure fluid will thereby be discharged from the cylinder spaces 33 below the pistons of the props 3 through the conduit 61 to the return conduit and the props 3 will thereby move to their collapsed position. At the same time, the pump pressure will pass through the conduit 34 to the cylinder space 35 surrounding the piston rod 5 of the advancing unit 2, causing thereby to advance the mine roof support 1 through a predetermined distance, while the props 3 of the mine roof support are in the collapsed position.

The pressure fluid passing through the channel 10 and past the sealing face 12 in the housing 11 will act further over a throttle 62 onto the left end face 63 of the stepped piston 23. The size of the end face 63 with respect to that of the annular opposite face 64 is about 1:1.55.

If the advancing unit 2 has finished its predetermined stroke or if the mine roof support 1 engages an obstacle, then the pressure acting on the end face 63 of the stepped piston 23 is automatically increased. Due to the size relationship between the end face 63 and the annular face 64 of the stepped piston 23 an increased pressure will result in the annular space or compartment at the right side of the stepped piston 23. If this pressure reaches a pressure to which an overpressure valve 65 is adjusted, which overpressure valve is arranged between an outlet channel 66 communicating with the annular space 21 and a conduit 67 leading to the return conduit T, then the overpressure valve 65 opens and fluid will flow from the cylinder space 21 into the return conduit T. Thereby the stepped piston can slowly move in axial direction towards the right, as viewed in FIG. 2, whereby the speed of such axial movement is determined by the flow cross-section of the throttle 62. Due to the fact that the pressure in the annular space 21 will be higher than the pump pressure, the one-way valve 20 between the annular space 21 and the cylinder space 19 will remain closed during movement of the stepped piston 23.

Determined by the flow-through cross-section of the throttle 62 the stepped piston is, for instance after four seconds, moved in axial direction toward the right through a distance so that a closer member 68 projecting forwardly from the closer body 26 engages a sealing face 69 of the stepped connecting channel 44 to separate thereby the space 43 from the return conduit T. During further movement of the stepped piston 23 toward the right, the closer member 25 is also disengaged from the sealing face 28 in the hollow cylinder 22. To assure that the closer member 25 will properly disengage from the sealing face 28, the sealing body 26 is provided with a longitudinal bore 70 thereto which will thus assure a pressure release at the sealing face. Furthermore, as mentioned before, the end face 63 has a larger area than the annular opposite face 64. This will assure that the resulting force in opening direction is always greater. The size of the annular face 64 will result from the size of the end face 63 minus the sealing face at the reduced extension of the closer body 26.

After the various elements of the valve arrangement have reached the aforementioned positions, the pressure fluid may pass from the space 19 over the one-way valve 20, the annular space 21, the cross-bore 24, past the closer member 25 into the space 43 and therewith over the channel 53, the conduit 54 and the check valves 55 into the cylinder spaces 33 of the props 3. The props 3 move thereby to the extended position in which the roof shield 4 will engage the roof of a mine gallery.

In this position of the stepped piston 23 pressure fluid will flow also over the throttle 47 to the space 48 at the right side of the return piston 49 and produces thereby a time delayed movement of the return piston 49 towards the left, as viewed in FIG. 2. Determined by the flowthrough cross-section of the throttle 47, the free end 71 of the push rod 50 connected to the return piston 49 will, for instance after four seconds, engage the check valve 60 in the impulse piston 37 to open the check valve. Thereby the pressure cushion, which up to this moment did hold the impulse piston 37 in the position moved towards the right, will be released through the longitudinal bore 36, the cross-bore 38 and the channel 39 to the return conduit T. The impulse piston 37 then moves, due to the pump pressure in the channel 10, in the opposite direction, that is towards the left, as viewed in FIG. 2. From this results that first the sealing cone 13 of the closer piston 15 will be pressed against the sealing face 16, preventing thereby flow of pressure medium past this sealing face. Subsequently thereto, the impulse piston 37 will be separated from the closer postion 15 so that the channel 29 will be again connected through the bores 36 and 38 in the impulse piston 37 with the return conduit T.

The pump pressure, acting further over the one-way valve 20 in the annular space 21 about the hollow cylinder 22 and in the space 43, will now cause the stepped piston 23 to move toward the left, as viewed in FIG. 2, so that the cylinder space or compartment 72 to the left side of the end face 63 of the stepped piston 23 will be time delayed discharged over the throttle 62. During the return movement of the stepped piston 23, the closer member 25 will be pressed first against the sealing face 28 and during further movement of the stepped piston 23 the closer member 68 will be disengaged from the sealing face 69 at the stepped channel 44. Pressure fluid will therefore flow from the space 43 through the stepped connecting channel 44 and the conduit 45 to the return conduit T and the cylinder space 43 will become pressureless. The setting of the mine roof support is thereby finished.

Since the pump pressure in the space 19 around the push rod 50 will act also on the return piston 49, the latter will be moved toward the right, as viewed in FIG. 2, so that pressure fluid from the space 48 to the right side of the return piston 49 will be slowly discharged over the throttle 47, the connecting channel 44 and the conduit 45 to the return conduit T.

The return piston 49, the stepped piston 23 and the members 15 and 37 have thus reached again their starting position, whereafter a new operating sequence for the mine roof support may be initiated.

It is possible to interrupt the operating sequence above described at any time by moving the impulse valve 8 to its left end position so that the space 58 at the left side of the impulse piston 37 is connected with the return conduit T.

It will be understood that each of the elements described above, or two or more together, may also find a useful application in other types of valve arrangements for operating a walking mine roof support differing from the types described above.

While the invention has been illustrated and described as embodied in a valve arrangement for operating a mine roof support in which movement of the props of the mine roof support to the collapsed position and advancing the mine roof support is automatically carried out in proper sequence with moving of the props again back to the extended position, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a combination with a walking mine roof support having a plurality of hydraulically operated props each movable between an extended position by feeding pressure fluid into a cylinder space below a piston thereof and a collapsed position by discharging pressure fluid from the cylinder space and advancing means comprising a hydraulically operable cylinder-and-piston unit for advancing the mine roof support upon feeding of pressure fluid into the cylinder of said unit, a valve arrangement for automatically first moving said props to said collapsed position and advancing the mine roof support by said advancing means and thereafter moving said props to said extended position, said valve arrangement comprising first valve means movable from a starting position to a working position for discharging pressure fluid from said cylinder spaces of said props to move the latter to said collapsed position and for feeding pressure fluid from a source of pressure fluid into said cylinder of said cylinder-and-piston unit to advance said mine roof support; and second valve means for subsequently feeding pressure fluid into the cylinder spaces of said props for moving the latter to said expanded position, said second valve means comprising a stepped piston fluid-tightly guided in a cylinder bore of said second valve means and dividing the cylinder bore in two compartments, first passage means controlled by said first valve means for time-delay transmitting the fluid pressure in said cylinder of said advancing means to one of said compartments on one side of said stepped piston after pressure fluid has been discharged from said cylinder space of said props, second passage means for transmitting the fluid pressure from said source into the other compartment to the other side of said stepped piston, a one-way valve in said second passage means, an overpressure valve connected to a return conduit and communicating with said other compartment and opening when the pressure in said other compartment surpasses the adjusted pressure of said overpressure valve causing thereby the stepped piston to move from a starting position to a second position in which fluid passes from said source to said cylinder spaces of said props, a return piston acted upon one side continuously by the fluid pressure of said source and on the other side thereof by the pressure in said cylinder spaces of said prop and cooperating with said first valve means for delaying feeding of pressure fluid from said source to said one compartment.

2. A valve arrangement as defined in claim 1, and including a throttle in said first passage means for causing the time delayed transmission of pressure fluid from said cylinder of said advancing means to said one compartment of said second valve means.

3. A valve arrangement as defined in claim 1, and including a spring-biased closer body having two axially spaced closer members coordinated with said stepped piston.

4. A valve arrangement as defined in claim 3, wherein said closer body is formed with an axial bore therethrough.

5. A valve arrangement as defined in claim 1, wherein said first valve means comprises two control members one of which is impingeable at one end thereof by the fluid pressure of said source, and a spring biasing the other member to a closed position, said one member including a one-way valve, and a push rod connected to said return piston and cooperating with said one-way valve of said one member.

6. A valve arrangement as defined in claim 5, wherein said one control member is an impulse piston provided with a longitudinal bore therethrough adapted to communicate with said source and a transverse bore communicating with said longitudinal bore and adapted to communicate with said return conduit, said one-way valve being located in said longitudinal bore, said control members having free ends normally spaced from each other and fluid tightly engaging each other upon feeding of pressure fluid against said one end of said impulse piston, thereby moving the other control member against the force of said biasing spring to an open position.

7. A valve arrangement as defined in claim 6, and including conduit means leading from said cylinder spaces of said props to said return conduit, and check valve means in said conduit means, said check valve means comprising a spring-pressed valve member normally preventing flow of fluid from said cylinder spaces to said return conduit and an opening piston which, when impinged by pressure fluid, opens said check valve, said other control member, when moved to said open position, establishing over a further conduit communication between said source of pressure fluid and said opening piston to thereby open said check valve in said conduit means so that pressure fluid will flow from said cylinder spaces of said props to said return conduit moving thereby said props to said collapsed position, and a branch conduit branching off from said further conduit upstream of said check valve means so that when said other control member is moved to said open position pressure fluid is also fed to said cylinder of said advancing means causing said mine roof support to advance.

8. A valve arrangement as defined in claim 1, and including an impulse valve coordinated with the first valve means.

* * * * *